US005405216A

United States Patent [19]

Allen et al.

[11] Patent Number: 5,405,216

[45] Date of Patent: Apr. 11, 1995

[54] FINISHING TROWEL PITCH CONTROL AND CLUTCH SYSTEM

[75] Inventors: J. Dewayne Allen, Paragould, Ark.; Ralph C. Luebke, Memphis, Tenn.

[73] Assignee: Allen Engineering Corporation, Paragould, Ark.

[21] Appl. No.: 35,800

[22] Filed: Mar. 23, 1993

[51] Int. Cl.[6] ..... E01C 19/00

[52] U.S. Cl. ..... 404/112; 404/133.1; 192/144

[58] Field of Search ..... 404/97, 112, 133, 72, 404/108, 111; 192/44, 85 A

[56] References Cited

U.S. PATENT DOCUMENTS

| | | | |
|---|---|---|---|
| Re. 28,561 | 9/1975 | Stephens | 192/44 |
| 3,007,378 | 11/1961 | Thieme et al. | 404/112 |
| 3,243,023 | 3/1966 | Boyden | 192/144 |
| 4,312,603 | 1/1982 | Whiteman | 404/112 |
| 4,673,311 | 6/1987 | Whiteman | 404/112 |
| 5,108,220 | 4/1992 | Allen et al. | 404/112 |

*Primary Examiner*—Ramon S. Britts
*Assistant Examiner*—Pamela Anne O'Connor
*Attorney, Agent, or Firm*—Stephen D. Carver; Trent C. Keisling

[57] ABSTRACT

An automatic, self locking clutch system effectuates blade pitch control on concrete finishing trowels. The clutch instantly releases upon the touch of the operator. A trowel has a downwardly projecting, motor-driven rotor comprising a plurality of radially spaced apart finishing blades directly contacting the concrete surface. A handle extends from a rigid frame and terminates in handlebars grasped by an operator. Control arms extend from the blades into contact with a plate to vary pitch by conventionally rotating the blades about their longitudinal axis. A clutch operatively interconnects a lever and a linkage extending to the swash plate. The clutch comprises a tubular housing coaxially receiving a drive shaft that rotatably controls an internal rotor. A set of spring biased, cylindrical rollers are confined within channels defined in the rotor between major and minor lobes thereof. The rollers are contacted by locking ledge portions of the channels and jammed into frictional engagement with the inner walls of the housing. The rollers thus wedgably lock the shaft to prevent rotation. A clutch actuator is coaxially fitted within the housing and driven by the lever for selectively unlocking the rollers and rotating the shaft to displace the linkage and establish the desired blade pitch. The shaft mounts an eccentric sprocket that directly drives a roller chain portion of the linkage. The eccentric sprocket provides an initial mechanical advantage, so trowel blade pitch is first finely adjusted, and as blade angle increases, lever response is coarser.

14 Claims, 6 Drawing Sheets

FINISHING TROWEL PITCH CONTROL AND CLUTCH SYSTEM

BACKGROUND OF THE INVENTION

The present invention broadly relates to concrete finishing machines. More particularly this invention relates to trowel blade adjustment mechanisms for motorized concrete finishing trowels. Art pertinent to the present invention is found in U.S. Class 404, Subclass 112.

Motorized finishing trowels are well known in the art. Typical trowels employ multiple, radially spaced apart blades that are secured to a motor-driven rotor. The rotor is forcibly revolved for finishing the concrete surface with the blades. The trowel blades rest directly on the concrete surface to be treated, so they support the machine's entire weight. Motorized trowels generally employ trowel blades that can be torsionally rotated relative to the concrete surface to change pitch. Both self-propelled "riding" trowels and manually "pushed" trowels (i.e., "walk-behind trowels") are well known in the art. Riding trowels have two or more blade-equipped rotors, whereas walk-behind trowels usually have single rotors.

Trowels may pass over the concrete surface several times as the concrete sets. The pitch of the blades is adjusted depending upon conditions. During the initial passes the blade pitch is relatively flat or horizontal. This spreads the weight of the machine over a relatively greater surface area, since the concrete is relatively wet and plastic at this time. During subsequent passes the concrete becomes less plastic, as it cures. The blade pitch is incrementally increased so the angle of incidence between the concrete surface and each blade face increases. During final passes the pitch of the blade may be near thirty degrees. Thus the blade pitch must be adjustable.

Manually manipulated motorized trowels are often referred to "power trowels" or "walk behind" trowels. Power trowels are generally comprised of a frame mounting a one cylinder internal combustion engine. Three or four horizontally-oriented, symmetrically disposed trowel blades are driven by the engine. Handlebar grips are generally provided on a handle extending from the frame to control the movement of the trowel during finishing operations.

Riding trowels are disclosed in U.S. Pat. Nos. 4,046,484 and 3,936,212 issued to Holz. Generally speaking riding trowels are comprised of a frame from which two or more rotating rotors downwardly project. A seat, mounted to the frame, is provided for the operator. The trowel is propelled by a self contained motor mounted on the frame. The weight of the trowel and the operator is transmitted frictionally to the concrete by the revolving blades. Locomotion results from the frictional forces between the blades and the surface. The rotors may be tilted from above to provide frictional differences that vector translate into steering forces. As these vector forces resolve, the desired trowel travel path is established. A yoke controlled bearing assembly is often employed to vary rotor pitch.

The pitch of the trowel blades may be manipulated by a swash plate that pushes downwardly on projections extending from the sides of the trowel blades. Downward force on the swash plate or pressure plate overcomes the machine's weight to adjust the pitch of the blades, by rotating them about their longitudinal axis.

Various blade pitch control mechanisms have been provided on trowels. Most allow adjustment of blade pitch before and during finishing operations. One such mechanism is a lever-actuated blade pitch control unit. A lever arm adjustment mechanism such as a swash plate is pivotally coupled to the trowel frame at a position close to the central axis of the trowel blades. Adjustments are made by manipulating a rather lengthy lever. The lever is usually locked in place by a gear tooth and dog arrangement. Another blade pitch adjustment mechanism employs a knob located between the handlebar grips of the trowel handle. Rotation of the knob turns a finely threaded adjustment mechanism coupled to the swash plate. As a result the blade pitch may be gradually increased or decreased.

U.S. Pat. No. 4,577,993 discloses a power trowel having a knob actuated blade pitch adjustment mechanism that can readily be modified to incorporate a lever-actuated blade pitch adjustment mechanism.

Whiteman, U.S. Pat. No. 4,637,311 discloses a concrete finishing machine having a counter balanced blade pitch adjustment apparatus. A lever is interconnected to the blades with a spring-loaded cable. The spring assists in maintaining the adjustment handle and the blades at the desired setting.

U.S. Pat. No. 4,577,993 issued on Mar. 25, 1986 to J. Dewayne Allen, a coinventor herein. It discloses a power trowel with a cam-actuated blade pitch adjustment mechanism. This invention is a lever type mechanism employing a cam assembly to allow fine adjustment of the pitch of the blades of a trowel. Other patent issued to Allen include U.S. Pat. No. 5,108,220 and U.S. Pat. No. Des. 323,510 both of which relate to riding trowels.

U.S. Pat. No. 4,320,986 relates to rotary trowels. Tertinek, U.S. Pat. No. 4,232,980, discloses a rotary powered trowel and a knob adjustment for blade pitch. Carlstrom, U.S. Pat. No. 4,198,178 speaks of a concrete floor finisher that also employs a screw type adjustment for the pitch of the blades.

Whiteman, U.S. Pat. No. 4,312,603 discloses a twin trowel finishing machine that employs two counter rotating blades to enable a larger machine to be handled by a single person. This patent also discloses a screw adjustment for blade pitch control.

Regardless of the type of adjustment mechanism employed, the skilled trowel operator must normally make numerous repetitive pitch adjustments. Sometimes, for example, a job will be partially shaded, so pitch changes are necessary every time the operator moves between sunlight and shade. Thus, as will be appreciated by those skilled in the trowel arts, a straight forward, easy-to-use adjustment for controlling blade pitch is desirous. With either walk-behind or riding trowels, frequent adjustments to pitch can be time consuming and exhausting. It is generally desirable to minimize the time the operator must expend to make blade pitch adjustments.

Known prior art trowels usually include some type of secondary restraining mechanism that must be separately released before an adjustment of blade pitch is possible. Therefore, an ideal pitch adjustment needs to be convenient to use with minimal effort. Furthermore, for purposes of efficiency and safety, the device must lock automatically when released. Concurrently, it must unlock quickly when intentionally activated. When deployed, it must quickly and reliably establish a selected blade pitch that will be proportional to operator displacement. The pitch must be reliably maintained when the device is released.

SUMMARY OF THE INVENTION

Our invention is a unique, self locking blade pitch control system that can be used on "walk-behind" or riding trowels. An operator may adjust the pitch of its blades without actuating a secondary lock. This promotes greater control over the machine during blade pitch adjustments. The disclosed trowel employs tabs disposed upon a cross strut of the frame to support auxiliary weights journalled to receive the tabs. A round, generally circular frame rail provides a convenient way to manually handle the machine in cooperation with an operator lifting the machine by its handlebars. A clutch is employed to provide the positive lock desired, and it works more efficiently the greater the weight supported.

A walk-behind trowel comprises a frame-mounted motor driving a blade assembly having a set of concrete finishing blades. A handle extending from the frame terminates in a set of handlebars to facilitate operation. Blade pitch is manipulated by an actuation or swash plate contacting control arms extending from each blade. A fork pivotally mounted to the frame moves the swash plate. In the present invention the fork is controlled by a linkage extending to a clutch. The operator adjusts the pitch of the blades by simply moving a lever extending from the clutch. When the lever is released the clutch automatically locks to prevent subsequent blade pitch variance.

The clutch is primarily comprised of a tubular, closed end housing concentrically mounting a shaft. The shaft and housing retain two spring-loaded rollers. An actuator extends partially into the housing to deactivate the rollers to disengage the clutch, allowing the shaft to rotate in a selected direction.

The shaft is generally elongated. It defines a stub, a partially threaded body and a keyed tail. A twin-lobed rotor is integral with the shaft. The threaded portion of the shaft receives a jam lock nut and spring washer to retain the shaft and actuator in the housing. Channels resembling right angled notches are cut into each side of the rotor for captivating the rollers. The channels separate the rotor into major and minor lobes. Each channel comprises a roller locking ledge contiguous with the major lobe and an intersecting roller idler ledge contiguous with the minor lobe.

Preferably the rollers are generally cylindrical. They are spring biased outwardly into contact with the race defined by the housing. Shaft rotation in a given direction is normally resisted by a roller forced into contact with the race by a roller locking edge of the rotor. When clockwise rotation is attempted, for example, one roller will be gently rolled by a roller idler ledge without locking, but the other roller will be jammed by the channel locking ledge. The roller wedges the mechanism, preventing rotation. The rollers on each side of the shaft prevent rotation in either direction unless disengaged by the clutch actuator.

The clutch actuator comprises an outside collar, a shoulder extending from the collar into the housing and a pair of tongues extending from the shoulder into the housing. The tongues contact the spring-loaded rollers. The lever is threadably secured in the collar. Moving the lever causes one of the tongues to depress the adjacent, otherwise-locking roller into the channel. As a result, the clutch unlocks the mechanism. When the clutch actuator is released the position is forcibly maintained, as the locking roller ramps along the channel ledge, into jamming contact with the housing.

A rotatable sprocket is eccentrically keyed to the shaft tail. A set screw prevents lateral movement of the sprocket. A chain extending upwardly from the linkage is secured to the offset sprocket. The sprocket's offset varies the mechanical advantage at the lever during adjustment of blade pitch. The operator has a greater mechanical advantage when the blades are disposed relatively flat. In other words, the resultant varying mechanical advantage puts the handle in "low gear" when adjusting the blades from a flat position. A fine adjustment of blade pitch at this crucial time is thus effectuated. When the blades are maximally pitched, less lever movement is required for revolving them.

Therefore, a primary object of the present invention is to provide an improved system for adjusting trowel blade pitch.

Another fundamental object is to make a blade pitch adjustment system that is easy to operate.

A significant object is to provide a greatly improved blade pitch adjustment system for trowels, including riding trowels and walk-behind trowels.

A related object of the present invention is to provide a trowel with a simple-to-use blade pitch adjustment.

A further related object of the present invention is to provide a power trowel with a pitch adjustment that does not require the manipulation of a secondary locking mechanism.

A still further object of the present invention is to provide a power trowel with a pitch adjustment locking mechanism that works more effectively the greater the weight disposed on the trowel. It is a feature of our invention that the greater the force directed downwardly on the blades, the tighter the clutch locks to maintain the selected blade pitch.

A related object of the present invention is to provide a trowel that mounts extra weights to facilitate finishing concrete.

An object of the present invention is to provide a power trowel in which the operating lever achieves a decreasing mechanical advantage as the blades are disposed at greater and greater angles.

Another object of the present invention is to provide a blade pitch adjustment system for a power trowel that locks once movement of the actuation lever ceases.

A related object of the present invention is to provide a power trowel employing a roller clutch that prevents movement of the trowel's blades around their longitudinal axis unless movement is initiated by a movement of an adjustment lever.

Another object is to provide a power trowel that has positive blade position locking.

A further object is to provide a blade pitch adjustment mechanism that requires minimum effort to operate.

Another object is to provide a blade pitch adjustment mechanism for a power trowel that may be adjusted through infinite increments.

An object of the present invention is to provide a power trowel exhibiting positive blade placement by merely moving a control lever.

Another object is to provide a power trowel with a minimum of components employed in the blade pitch adjustment mechanism.

A further object is to provide a power trowel in which no spring lift assistance is required.

Another fundamental object of our system is to provide a blade pitch control system wherein the force required to be exerted by the operator is varied in relation to the difficulty of moving the blades.

Another desirable object is to provide a power trowel blade pitch adjustment mechanism requiring minimal or no maintenance for the life of the machine.

A further object of the present invention is to provide a power trowel requiring only easy pressure to effect blade pitch adjustment through the entire range of operation.

An object of the present invention is to provide a power trowel with a positive pitch control that is safe to operate.

A related object of the present invention is to provide a power trowel that does not employ secondary blade pitch locking mechanisms.

Another object is to provide a power trowel with a blade control system superior to other systems of blade control offered in the industry.

Still another object is to provide a blade pitch adjustment system for power trowels that greatly eases trowel use.

Another object is to provide a power trowel with a blade position control that is fast, easy to use, safe, trouble-free and requires no adjustment, no periodic maintenance or special instruction for use.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

Figure 1:
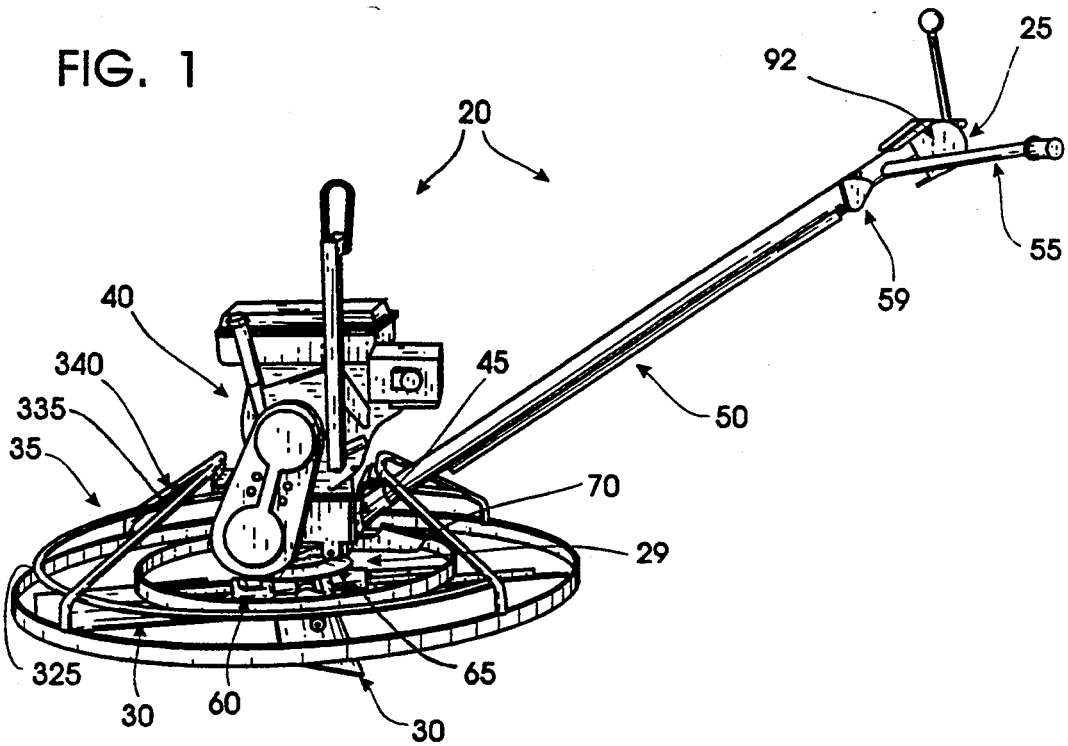
FIG. 1 is a fragmentary perspective view of a power trowel incorporating the teachings of our invention.
Figure 2:
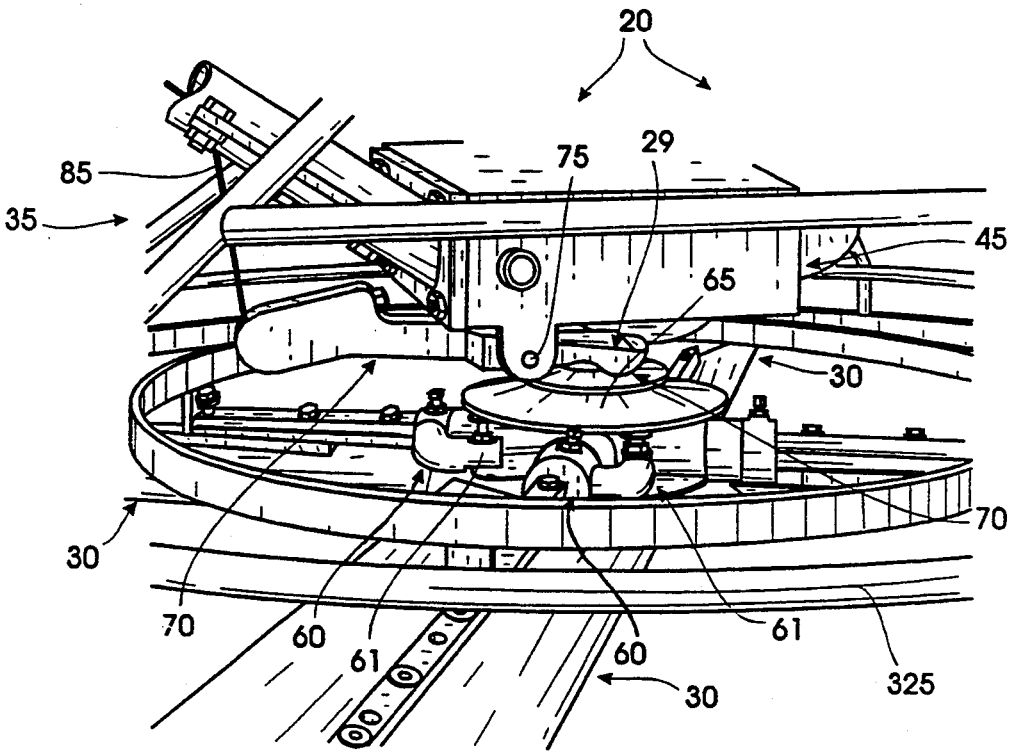
FIG. 2 is an enlarged fragmentary perspective view showing the blade pitch varying swash plate and typical associated structure.
Figure 3:
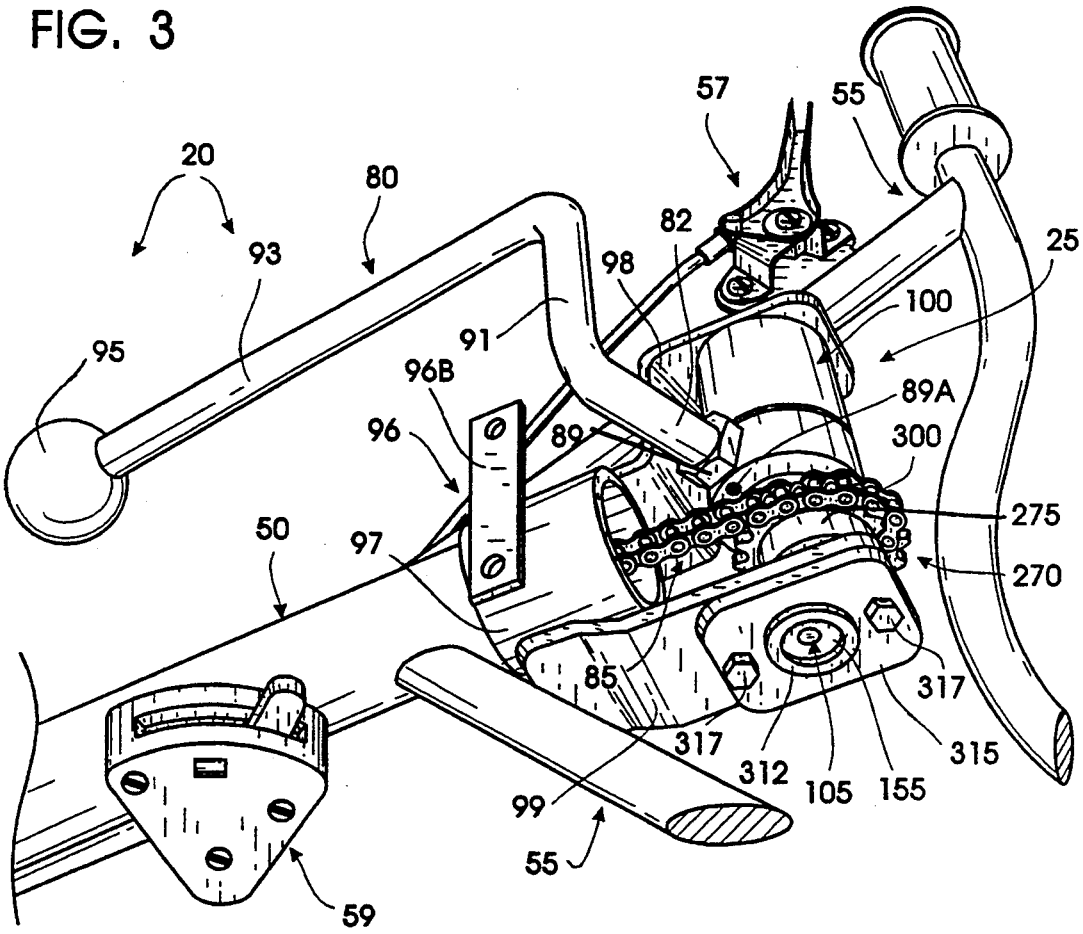
FIG. 3 is an enlarged, fragmentary isometric view of the handle portion of our trowel, showing the clutch and the actuation lever.

DETAILED DESCRIPTION with initial reference directed now to FIGS. 1–3 of the accompanying drawings, the herein disclosed trowel is broadly designated by the reference numeral 20. Our power driven concrete finishing trowel 20 employs a clutch 25 to selectively vary pitch in the concrete finishing blades 30. The clutch system 20 herein disclosed may be employed with trowels employing structure different from that shown, and it is therefore to be emphasized that the disclosed trowel finishing blade detail is merely exemplary. Clutch 25 system may be employed on either walk-behind or riding trowels. Additionally, the clutch system may be used for devices other than trowels.

Trowel 20 comprises a frame 35 mounting a conventional motor 40 that drives a rotary blade assembly 29 (sometimes known in the art as a rotor) via a transmission or other gear reduction system 45. A handle 50 is attached to components of the frame 35 or transmission 45. Handlebars 55 facilitate operation by a workman. Controls such as a throttle 57 and kill switch 59 are mounted on the handle 50 or handlebars 55. A plurality of radially spaced apart rotary finishing blades 30 emanate from the blade assembly. The pitch of the blades 30 is adjustable by rotating them about their longitudinal axis, as described in several of the patents discussed previously. Blade pitch adjustment structure is disclosed in detail in prior Allen Engineering U.S. Pat. No. 5,108,220 issued Apr. 28, 1992 owned by a common assignee, which patent is hereby incorporated by reference.

Control arms 60 connect to each blade 30 (FIG. 2). The control arms 60 comprise an offset portion 61 manipulated by an actuation plate 65 (often referred to as a swash plate) in turn activated by a conventional fork 70 that pivots from frame 35 at a convenient point 75 (FIG. 2) . When depressed, arm portion 61 rotates its associated blade about the blade's longitudinal axis. The fork 70 is connected to an adjustment mechanism for manipulation. In the present invention the adjustment mechanism comprises a lever 80 interconnected to the flexible linkage 85 by a roller clutch 25.

Figure 4:
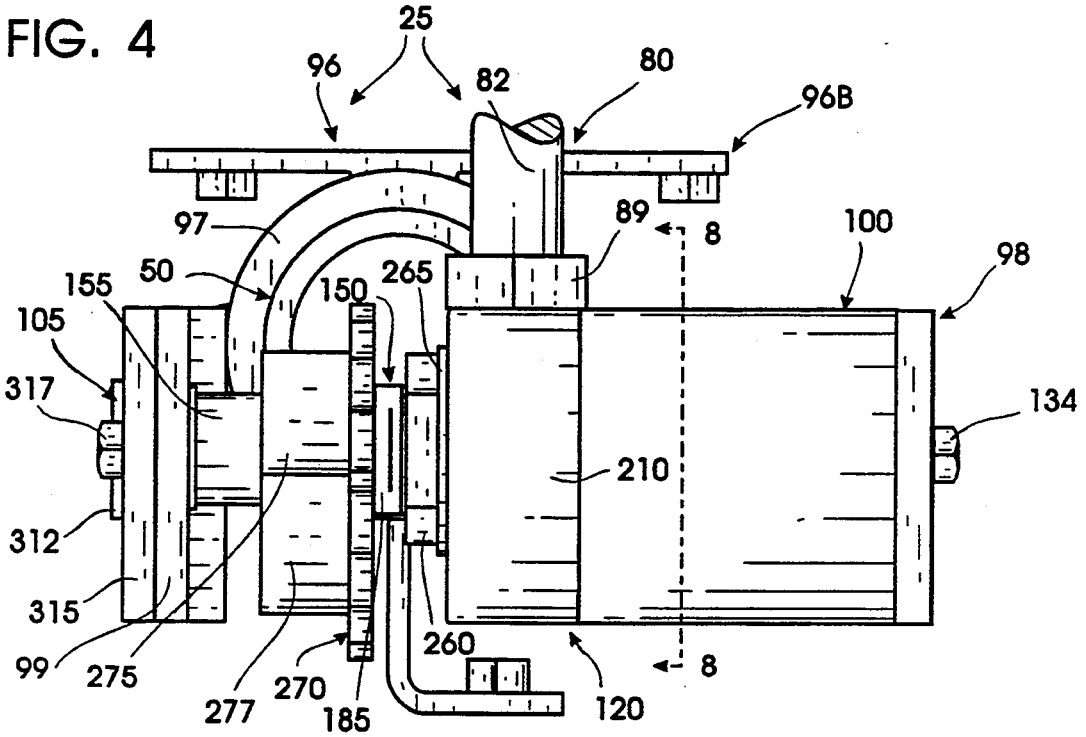
FIG. 4 is an enlarged fragmentary elevational view of the clutch system, as viewed generally from the right side of FIG. 3.
Figure 5:
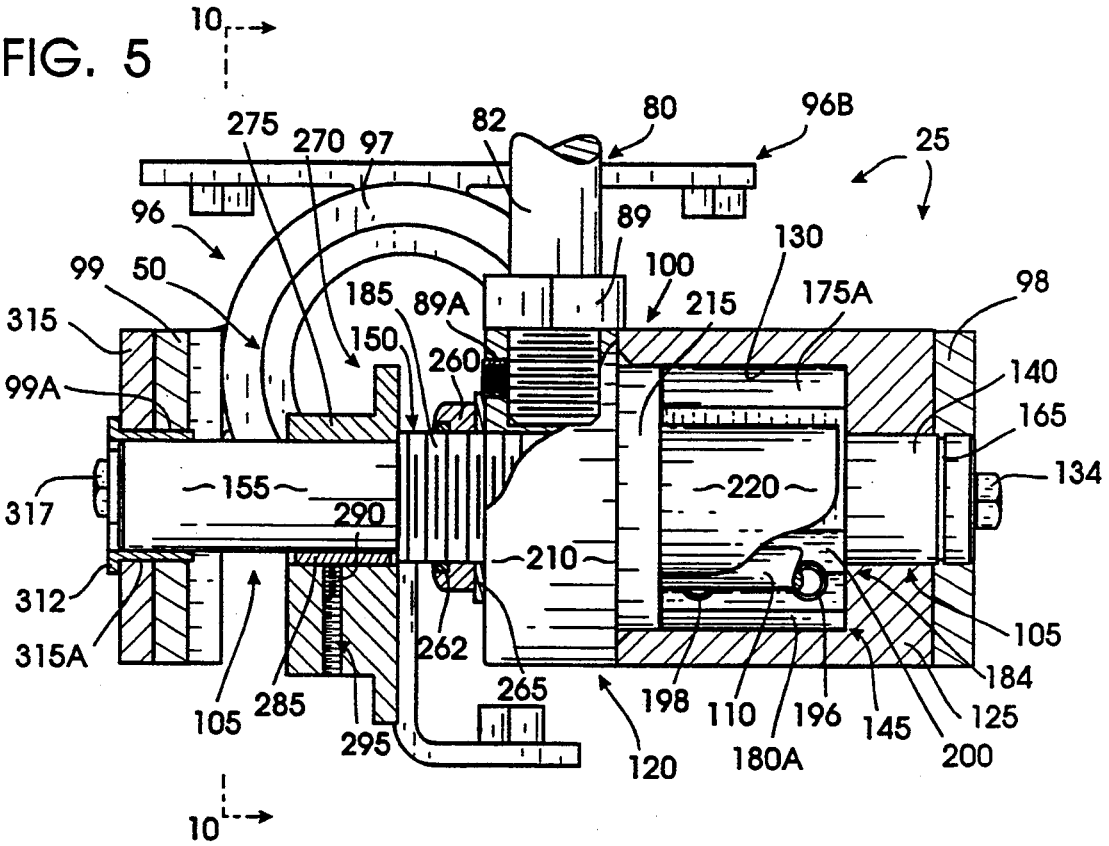
FIG. 5 is an enlarged, fragmentary longitudinal sectional view of the clutch, taken generally from the same vantage point as FIG. 4.

Our clutch 25 allows the operator to adjust the pitch of the blade's 30 by radially moving the lever 80. When the lever 80 is released the clutch 25 "locks" to prevent further movement of the blades 30. The lever 80 (FIG. 3) is constructed of a continuous piece of steel rod or the like, bent as illustrated and threaded on each end. The lever 80 comprises a threaded shank 82 (FIG. 3), a cross piece 91 and an extension 93 terminating in a knob 95. The shank 82 is screwed into the clutch 25. The lever 80 is secured against rotation by a nut 89 (FIG. 4) and a set screw 89A (FIGS. 3, 5).

Clutch 25 (FIG. 3) is preferably mounted on the handle 50 by a three-piece bracket 96. The bracket comprises a handle-receptive collar 97 that supports a right arm 98 and an offset left arm 99 (FIG. 3). Arms 98 and 99 are transversely aligned to receive and mount the clutch 25 which is mated to suitable bolting orifices. A protective shroud 92 (FIG. 1) is mounted to a cross piece 96B (FIG. 4) covering the clutch 25.

Figure 6:
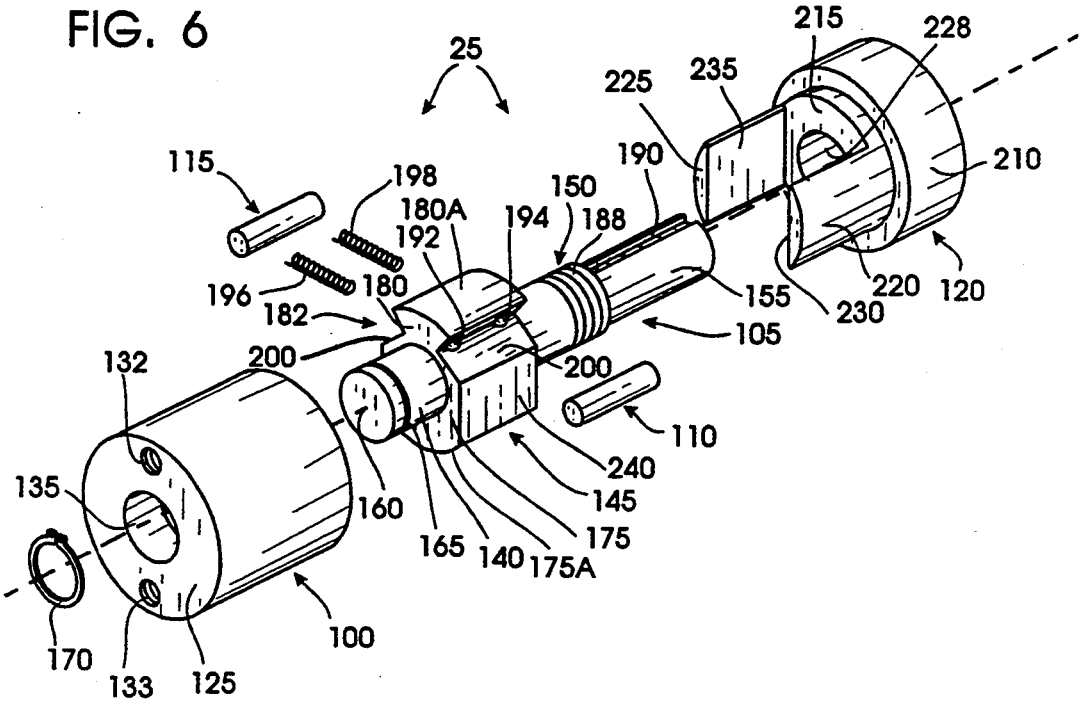
FIG. 6 is an enlarged fragmentary exploded isometric view of the clutch.

The clutch 25 comprises a rigid, tubular housing 100 (FIGS. 4–6) concentrically mounting a shaft 105 (FIG. 6). Rotation of shaft 105 is controlled by two spring loaded rollers 110, 115. As will be explained hereinafter, a clutch actuator 120 (FIG. 6) extends partially into the housing 100 to deactivate the rollers 110, 115 to unidirectionally disengage the clutch 25.

The clutch housing 100 is generally tubular and comprises a terminal end 125. The interior surface 130 (FIGS. 8, 9) of the housing 100 functionally comprises a race. Two tapped orifices 132, 133 in end 125 (FIG. 6) facilitate mounting of the clutch 25 to the L-shaped arm 98 of the bracket 96 by a pair of bolts 134 (FIGS. 4, 5). A coaxial orifice 135 is defined in end 125 of the housing 100 to receive a stub end 140 (FIGS. 6, 7) of the shaft 105.

The generally elongated shaft 105 defines a stub 140, a lobed rotor 145 (FIGS. 6, 7), an integral body 150, and a tail 155. The center 160 of the shaft 105 is coincident with the longitudinal axis of the entire clutch 25. The stub 140 passes through the central orifice 135 defined in the housing end 125. A circumferential groove 165 (FIG. 6) is defined in the stub end 140. It receives a snap ring 170 (FIGS. 6, 7) to axially secure the shaft 105 within housing 100. The body 150 of the shaft 105 extends from inside the housing 100 through the open end outside the housing 100. A portion 185 (FIG. 4) of the shaft body 150 is threaded at 188 (FIG. 6). The tail 155 of the shaft 105 has a reduced diameter and defines a keyway 190.

Rotor 145 is preferably integral with the drive shaft 105 and is coaxially retained within the housing 100. The rotor defines integral major and minor lobes 175, 180 respectively. The lobes 175, 180 have outer curved surfaces 175A, 180A respectively spaced apart from the center 160 of the shaft 105. The curved surfaces 175A, 180A tend to coaxially align the rotor 145 within race 130. A pair of elongated channels 182, 184 are defined on opposite sides of the rotor. They divide the rotor 145 into the major and minor lobes. The notch-like channels 182, 184 are generally formed from intersecting right angle cuts into the rotor body. The channels 182, 184 are spaced apart from the center 160 of the shaft 105. Each channel has a locking ledge 200 contiguous with the major lobe, and the companion idler ledge 201 contiguous with the minor lobe. The channels 182, 184 captivate the rollers, which as described hereinafter, may bind against the race. A separate roller and channel pair resist counterclockwise or clockwise rotation.

Preferably the rollers 110, 115 are generally cylindrical and are longitudinally disposed within the channels 182, 184. Spring passageways 192, 194 (FIGS. 5, 6) pass transversely through the rotor 145 between the channels 182, 184 to captivate a pair of springs 196, 198. As viewed best in FIGS. 8 and 9, the springs bias the rollers 110, 115 outwardly into firm contact with the race 130 in the proximity of channels 182, 184. As the shaft 105 attempts to rotate clockwise (i.e., as viewed in FIGS. 8, 8A) a roller 115 "ramps" along the locking ledge 200 of the channel 184 into frictional, jamming contact with the surrounding race 130. At this time the opposite roller 110 is simply radially deflected within the housing by its adjacent idler ledge 201, and it does not jam to resist shaft rotation. However, roller 110 similarly jams against race 130 when the direction of rotation is reversed (i.e., counterclockwise as viewed in FIG. 8), whereupon it is wedged by its adjacent locking ledge 200. Due to the twin rollers 110 or 115 normally engaging the race 130, the shaft 105 is jammed and locked, preventing rotation. Since there are rollers 110, 115 located on either side of the shaft 105, it cannot rotate in either direction unless disengaged by the clutch actuator 120.

Figure 7:
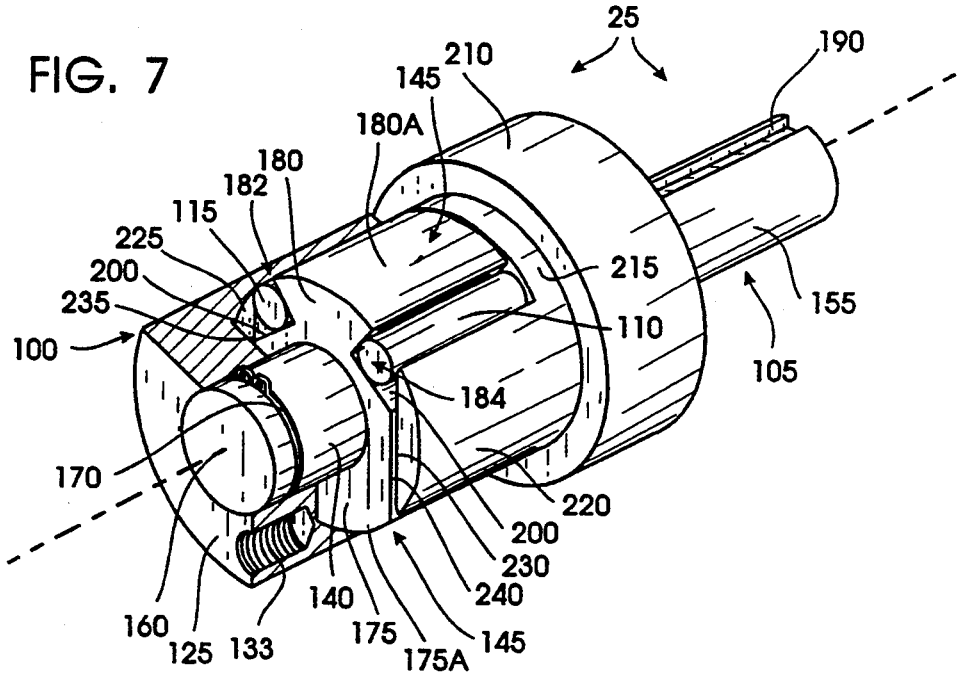
FIG. 7 is an enlarged fragmentary assembly view primarily of the clutch rotor and actuator.
Figure 8:
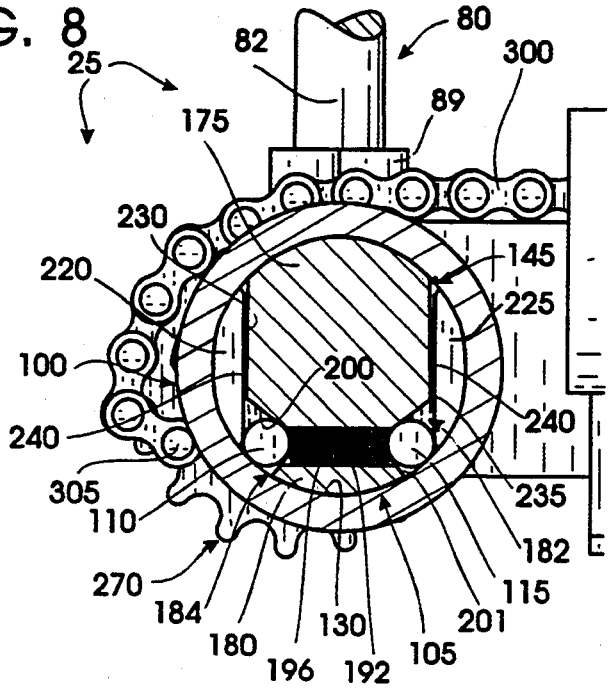
FIG. 8 is a fragmentary vertical sectional view of the clutch taken generally along line 8—8 of FIG. 4.
Figure 8A:
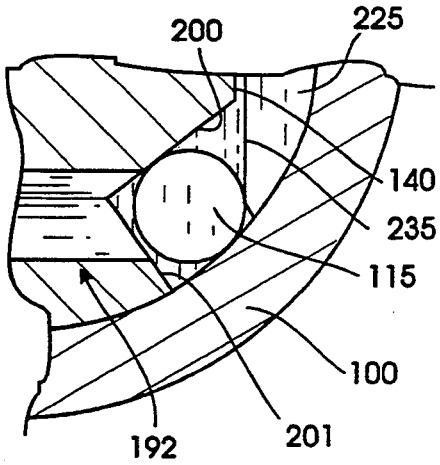
FIG. 8A is greatly enlarged fragmentary sectional view showing a portion of FIG. 8, with portions thereof omitted for brevity.

The clutch actuator 120 (FIGS. 6–8) comprises outside collar 210, a shoulder 215 and a pair of projecting elongated, parallel tongues 220, 225. The collar 210 and shoulder 215 have a concentric central orifice 228 to accommodate shaft 105. The collar 210 has approximately the same outside diameter as the housing 100. The shoulder 215 extends from the collar 210 and fits coaxially within housing 100; its outer diameter facilitates coaxial sliding contact with the race 130. The tongues 220, 225 extend from the shoulder 215 into the housing 100. The tongues 220, 225 are continuations of diametrically opposed portions of the shoulder 215. Hence, the outer radii of the tongues 220, 225 are the same as the shoulder 215. The radius allows sliding contact of the tongues 220, 225 adjacent the rotor 145. This radius is also similar to the outer radius of the shaft lobes 175, 180. The inner "chord-like" surfaces 230, 235 of the tongues 220, 225 come within close proximity of the vertical faces 240 on opposite sides of the major lobe 175 (FIGS. 7, 8). A chord 230 or 235 may selectively displace one of rollers 110 or 115 deeper into its channel 182 or 184 to disengage the clutch 25. When the actuator rotates, the chord surfaces 230, 235 of the actuator unlock that roller 110 or 115 that would otherwise be jammed against race 130 by the locking ledge 200.

Figure 9:
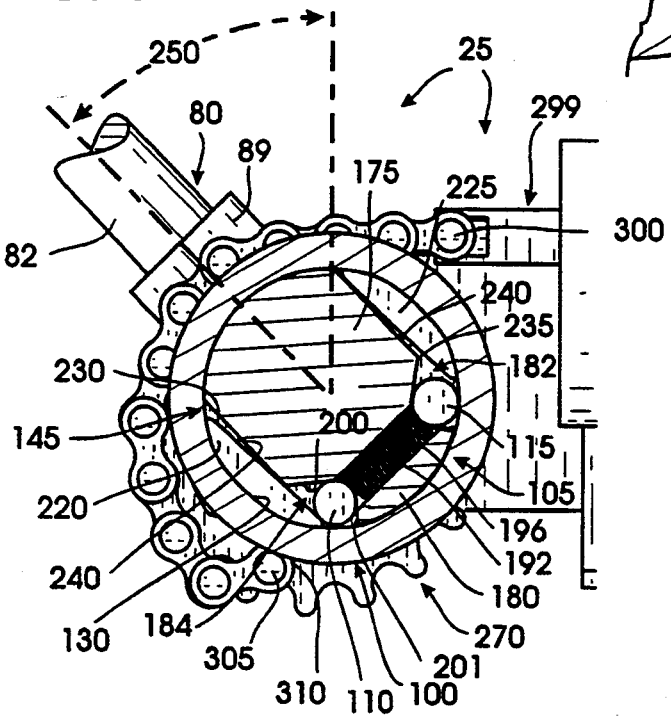
FIG. 9 is a view similar to FIG. 8, but showing the actuator radially displaced to a moved position.

The clutch operating lever 80 is threadably secured in the collar 210 of the clutch actuator 120. As illustrated in FIG. 9, radial movement of lever 80 (i.e., as indicated by arrow 250 in FIG. 9) causes a small movement of the clutch actuator 120 relative to the shaft 105. As a result of the movement, the chord portion 230 of the actuator trailing the direction of movement 250 deflects the adjacent spring loaded roller 110. The roller 110 is displaced deeper into the channel 184, along the restraining ledge 200, unwedging the lobe 180 and the race 130. This disengages the clutch 25 allowing movement of the shaft 105 in one direction. When the clutch 25 actuator 120 is released, the shaft 105 tends to rotate slightly due to the weight of the machine loading the linkage 85. When the tongues ceases to contact the roller 110, it ramps outward along the restraining ledge 200 of the channel 184, again locking the clutch 25.

The threaded portion of the shaft body 150 receives a jam nut 260 (FIGS. 4, 5). The jam nut 260 is a crown type nut with a plastic insert 262 to prevent the nut 260 from backing off due to vibration. The jam nut 260 is tightened against a spring washer 265. Spring washer 265 contacts the clutch actuator 120 retaining the shaft 105 and actuator 120 in the housing 100. Nut 260 is adjusted to vary the tension on the spring washer, and when properly adjusted loose motion of the shaft will be resisted. In other words, pressure on the washer 265 is transferred to the actuator collar 210 retaining it within the housing and preventing the actuator 120 and the attached lever 80 from being loose. Nut 260 tensions the shaft 105 against the snap ring 170 securing it within the housing. The resultant opposing pressure and tension provided by the nut 260 and washer 265 maintain the actuator 120 and shaft 105 in the proper relationship to prevent inadvertent release due to vibration and acts as an adjustable drag on clutch operation.

Figure 10:
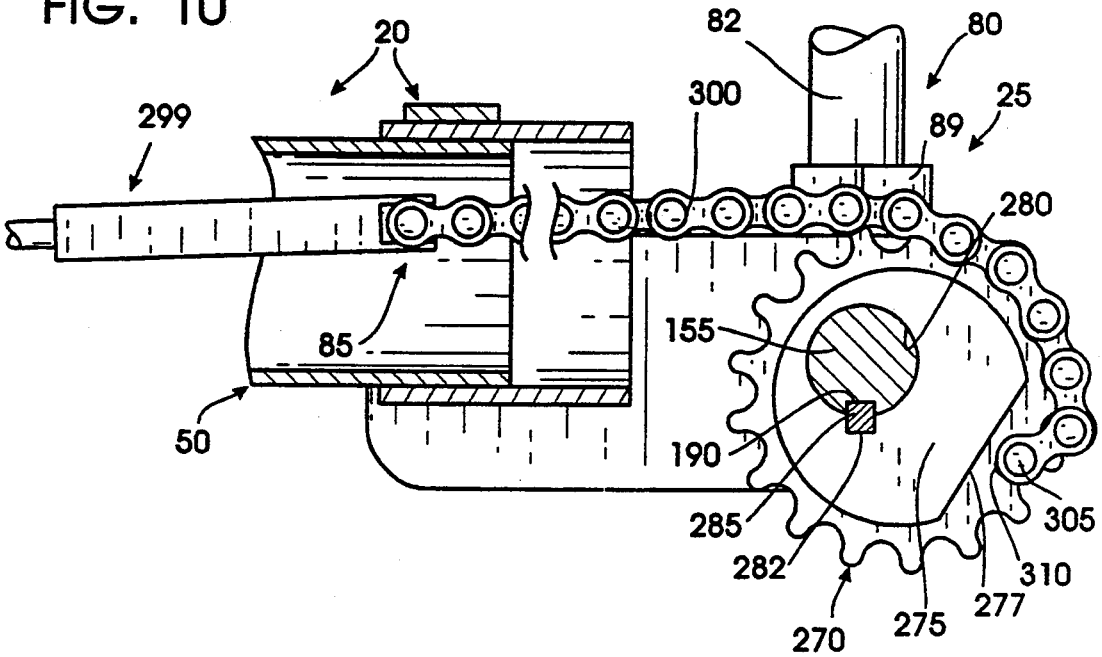
FIG. 10 is an enlarged fragmentary elevational view taken generally along line 10—10 of FIG. 5, illustrating the eccentric gear; and, FIG. 11 is a view similar to FIG. 10 showing the actuator lever radially displaced to a moved position.

An eccentric sprocket 270 (FIGS. 8, 9) is disposed on the tail 155 of the shaft 105. (In the preferred mode the sprocket is actually round, but its center of rotation is offset.) Sprocket 270 has an inner hub 275 with a flat 277. The sprocket 270 and hub 275 have an offset bore 280. A keyway 282 is defined in the bore 280. A key 285 is disposed in the keyways 282 and 190 of the sprocket 270 and shaft 105, radially locking the sprocket 270. A set screw 290 (FIG. 5) is threaded into an orifice 295 in the hub 275. The set screw 290 contacts the key 285 to prevent lateral movement of the sprocket 270 along the shaft 105. A chain 300 extending upwardly as a part of the linkage 85 is secured to the sprocket 270 by a pin 305 passing through a hole 310 defined in the sprocket 270 adjacent the flat 277. Linkage cable 299 (FIG. 10, 11) runs to the conventional fork for adjusting the pressure or swash plate previously described.

The sprocket's offset results in varying mechanical advantage at the lever 80 during adjustments of blade pitch due to the changing distance between the center of rotation of the lever 80 and the sprocket teeth. The lever 80 needs to be moved the most at the beginning, to get the blades to initially "break over" from horizontal to a slight incline. In other words the system is "geared down" initially when the blades first start to move, so it is easier on the operator. Therefore, whenever the trowel blades are flat the blade adjustment is relatively fine. In other words, when the blades 30 are disposed in a relatively flat position, a major movement of the lever 80 allows a small relative movement of the blades 30 about the longitudinal axis of the blades.

Figure 11:
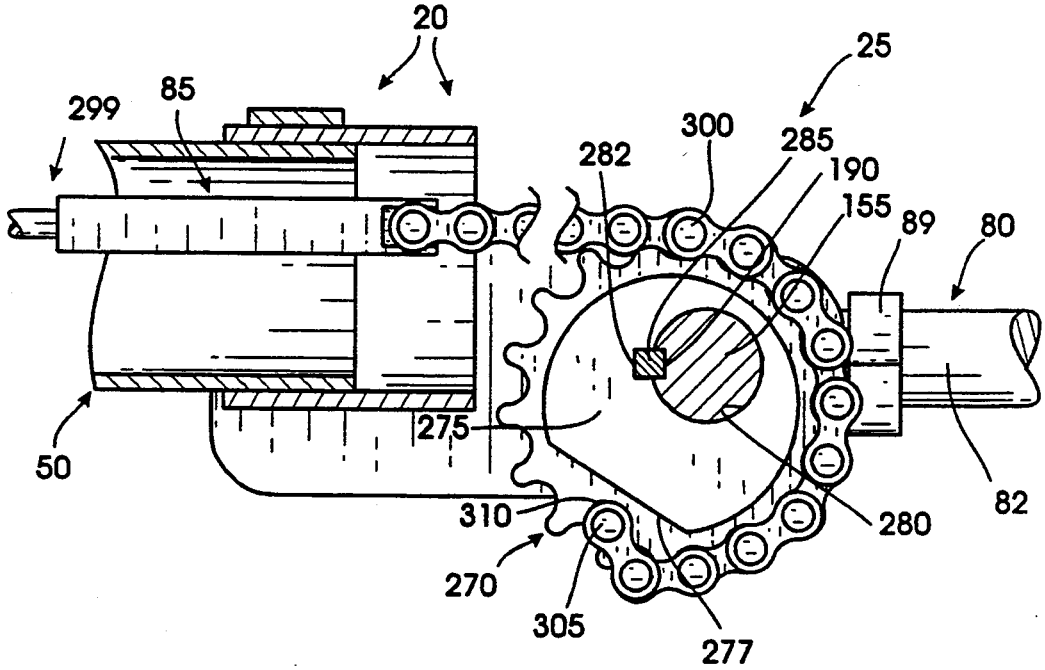

As the sprocket 270 rotates, the gear ratio changes, thereby increasing the relative degree of rotation of the blades 30 (FIG. 11) per unit movement of the lever 80. This gives the operator an initial mechanical advantage and allows for finer adjustment of the blades 30. When the lever is rotated further, less of a mechanical advantage results (i.e., the blades rotate more degrees per degree of lever movement). This coarser adjustment facilitates finishing the concrete as it sets, since the blades 30 are usually disposed at a greater angle during final finishing operations.

The tail 155 of the shaft 105 is received by a bushing 312 pressed into the central orifice 99A (FIG. 5) defined in the offset bracket arm 99. The clutch 25 is further stabilized by a reinforcing plate 315 bolted to the bracket arm 99. The reinforcing plate is secured through the bolting orifices defined on either side of the central orifice 99A by bolts 317. The bushing 312 also passes through a central orifice 315A defined in the reinforcing plate 315.

A further modification includes a circular, tubular frame rail 325 near the front of the machine (FIG. 1). This rail 325 provides a convenient handhold for a helper to lift the machine 20 while the operator lifts at the handlebars 55.

The present power trowel 20 may employ auxiliary weights to facilitate concrete finishing operations. The weights are adapted to index with tabs 335 disposed on a frame cross bar 340. The clutch 25 employed herein works more efficiently the greater the force applied to it. Therefore, the addition of weights places greater downward force on the blades 30 resulting in a transfer of the force through the control arms 60, swash plate 65, linkage 85 and sprocket 270 to the clutch 25.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A concrete finishing trowel comprising:

a rotatable blade assembly adapted to finish a concrete surface, said assembly having a generally vertical axis of rotation and a plurality of radially spaced apart concrete finishing blades extending outwardly from said vertical axis for frictionally contacting said concrete surface, said blades each defining a longitudinal axis generally perpendicular to said vertical axis;

pitch control means for varying the pitch of said blades by rotating them about their longitudinal axis;

lever means for operating said pitch control means, said lever means comprising eccentric sprocket means for obtaining a mechanical advantage and linkage means extending between said sprocket means and said pitch control means; and, clutch means for selectively frictionally locking and unlocking said lever means.

2. The trowel as defined in claim 1 wherein said linkage means comprises an elongated flexible link at least partially entrained about said sprocket and extending to said pitch control means.

3. The trowel as defined in claim 2 wherein said link comprises a roller link chain revolvably coupled to said sprocket and interconnected to a cable, said cable connected to an activating fork associated with said pitch control means.

4. The trowel as defined in claim 1 wherein said sprocket achieves a variable mechanical advantage.

5. A motor powered trowel for concrete finishing, said trowel comprising:

frame means for supporting the trowel;

rotatable blade means projecting beneath said frame for contacting and finishing a concrete surface, said blade means comprising a plurality of radially spaced apart blades extending outwardly from a central rotor for frictionally finishing the surface, said blades each defining a longitudinal axis generally perpendicular to said central rotor;

pitch control means for varying the pitch of said blades by rotating them about their longitudinal axis;

clutch means for activating said pitch control means comprising:

a stationary housing having an interior;

a drive shaft coaxially, rotatably mounted in said housing and linked to said pitch control means;

a rotor driven by said drive shaft, said rotor comprising a pair of elongated channels parallel to and spaced apart from said drive shaft;

a pair of rollers disposed within said channels adapted to be frictionally jammed into contact with said housing to temporarily lock said drive shaft against rotation relative to said housing and to lock said pitch control means and said blades in a desired pitch orientation; and, an actuator generally coaxially fitting within said housing for selectively rotatably unlocking said locking means and rotating said drive shaft;

a pitch control lever coupled to said drive shaft for selectively controlling said clutch; and, linkage means for eccentrically tensioning said pitch control means.

6. The trowel as defined in claim 5 including spring means for yieldably biasing said rollers into jamming engagement with the housing.

7. The trowel as defined in claim 6 wherein said rotor comprises interior spring passageways perpendicularly extending between said channels.

8. The trowel as defined in claim 5 wherein said actuator comprises a pair of tongues extending into said housing for selectively unlocking said clutch by unjamming a roller.

9. The trowel as defined in claim 8 wherein said channels comprise a roller locking ledge and a roller idler ledge.

10. The trowel as defined in claim 5 wherein said linkage means comprises a sprocket driven by said drive shaft and an elongated linkage at least partially entrained about said sprocket and extending to said swash plate means.

11. The trowel as defined in claim 10 wherein said linkage comprises a roller link chain revolvably coupled to said gear and interconnected to a cable, said cable connected to an activating fork associated with said pitch control means.

12. A motor-driven concrete finishing trowel, said trowel comprising:

a rigid frame;

a handle extending from said frame for manipulation by an operator;

a rotatable blade assembly projecting from said frame adapted to finish a concrete surface, the assembly having a generally vertical axis of rotation and a plurality of radially spaced apart concrete finishing blades extending outwardly from said axis for frictionally contacting a concrete surface to be finished;

said blades each defining a longitudinal axis generally perpendicular to said vertical axis;

pitch control means for varying the pitch of said blades by rotating them about their longitudinal axis;

clutch means for operatively controlling said pitch control means, said clutch means comprising:

a stationary housing having an interior;

a drive shaft coaxially, rotatably mounted in said housing and linked to said pitch control means;

a rotor driven by said drive shaft, said rotor comprising a pair of elongated channels parallel to and spaced apart from said drive shaft, said channels comprising a roller locking ledge and a roller idler ledge;

a pair of rollers disposed within said channels adapted to be frictionally jammed into contact with said housing to temporarily lock said drive shaft against rotation relative to said housing and to temporarily lock said pitch control means and said blades in a desired pitch orientation;

a pair of springs yieldably biasing said rollers into jamming engagement with the housing, said springs disposed in a pair of spring passageways in said rotor, said passageways perpendicularly extending between said channels; and, an actuator generally coaxially fitting within said housing for selectively rotatably unlocking said locking means and rotating said drive shaft, said actuator comprising a pair of tongues extending into said housing for selectively unlocking said clutch by unjamming a roller;

a pitch control lever coupled to said actuator for selectively controlling said clutch to activate said pitch control means to establish a desired blade pitch a sprocket driven by said drive shaft and a roller link chain at least partially entrained about said sprocket and extending to said pitch control means, said sprocket eccentrically associated with said drive shaft to achieve a variable mechanical advantage; and, a cable interconnected to said chain, said cable connected to an activating fork associated with said pitch control means.

13. A concrete finishing trowel comprising:

a rotatable blade assembly adapted to finish a concrete surface, the assembly having a generally vertical axis of rotation and a plurality of radially spaced apart concrete finishing blades extending outwardly from said axis for frictionally contacting a concrete surface to be finished;

said blades each defining a longitudinal axis generally perpendicular to said vertical axis;

pitch control means for varying the pitch of said blades by rotating them about their longitudinal axis; and, clutch means for controlling said pitch control means, said clutch means comprising:

a rigid housing having an interior;

a drive shaft coaxially, rotatably mounted in said housing and linked to said pitch control means;

locking means for at least temporarily locking said drive shaft against rotation relative to said housing to lock said pitch control means and said blades in a desired pitch orientation;

an actuator generally coaxially fitting within said housing and driven by said lever for concurrently unlocking said locking means and activating said pitch control means to establish a desired blade pitch; and, jam nut means for variably tensioning said drive shaft.

14. A motor-driven concrete finishing trowel, said trowel comprising:

a rigid frame;

a handle extending from said frame for manipulation by an operator;

a rotatable blade assembly projecting from said frame adapted to finish a concrete surface, the assembly having a generally vertical axis of rotation and a plurality of radially spaced apart concrete finishing blades extending outwardly from said axis for frictionally contacting a concrete surface to be finished;

said blades each defining a longitudinal axis generally perpendicular to said vertical axis;

pitch control means for varying the pitch of said blades by rotating them about their longitudinal axis;

a pitch control lever for selectively activating said pitch control means;

clutch means for operatively interconnecting said lever and said pitch control means, said clutch means comprising:

a stationary housing having an interior;

a drive shaft coaxially, rotatably mounted in said housing and rotatably linked to said pitch control means;

roller locking means for at least temporarily locking said drive shaft against rotation relative to said housing to lock said pitch control means and said blades in a desired pitch orientation;

an actuator generally coaxially fitting within said housing and driven by said lever for concurrently unlocking said locking means and activating said pitch control means to establish a desired blade pitch; and, a jam nut secured on said drive shaft maintaining said drive shaft and said actuator within said housing and variably tensioning said drive shaft.

* * * * *